US005860802A

United States Patent [19]

Densch

[11] Patent Number: 5,860,802

[45] Date of Patent: Jan. 19, 1999

[54] ROTARY PISTON MACHINE WITH SEALING RODS

[75] Inventor: Dietrich Densch, Neunkirchen-Seelscheid, Germany

[73] Assignee: Bernd Schüll, Köln, Germany

[21] Appl. No.: 784,122

[22] Filed: Jan. 15, 1997

[30] Foreign Application Priority Data

| | | | |
|---|---|---|---|
| Jan. 15, 1996 | [DE] | Germany | 196 01 148.5 |
| Feb. 2, 1996 | [DE] | Germany | 196 03 669.0 |

[51] Int. Cl.[6] ..... F01C 1/28; F01C 19/00

[52] U.S. Cl. ..... 418/104; 418/196

[58] Field of Search ..... 418/104, 196

[56] References Cited

U.S. PATENT DOCUMENTS

| | | | |
|---|---|---|---|
| 1,349,882 | 8/1920 | Homan | 418/196 |
| 2,097,881 | 11/1937 | Hopkins | 418/196 |
| 3,809,026 | 5/1974 | Snyder | 418/196 |
| 4,934,325 | 6/1990 | Snyder | 418/196 |
| 4,968,234 | 11/1990 | Densch | 418/196 |
| 5,341,782 | 8/1994 | McCall et al. | 418/196 |

*Primary Examiner*—John J. Vrablik
*Attorney, Agent, or Firm*—Friedrich Kueffner

[57] ABSTRACT

A rotary piston machine includes a piston arrangement mounted in a gas-tight interior housing, wherein the piston arrangement has at least four individual rotary pistons which are constructed essentially equally and have end faces which are arranged so as to be in alignment with each other. The rotary piston machine further includes sealing assemblies composed of positioning members and sealing rods, wherein a sealing assembly is provided for each gap between adjacent rotary pistons and wherein each sealing assembly includes at least one sealing rod. The center points of circular arcs with two different radii defining the cross-section of each rotary piston are located on the corner points of a rhombus and the center points of the larger circular arcs are located in the corner points with the larger rhombus angles, wherein the larger rhombus angle is greater by 50° to 50° than the smaller rhombus angle. The sealing rods have cross-sectional areas in a direction perpendicularly to the longitudinal axes of the sealing rods which are defined outwardly by a circle. The sealing rods are freely rotatable about their longitudinal axes.

14 Claims, 9 Drawing Sheets

M=1:1
0 10 20 30 40 50mm

ROTARY PISTON MACHINE WITH SEALING RODS

BACKGROUND OF THE INVENTION

1. Field of the Invention

The present invention relates to a rotary piston machine with a piston arrangement mounted in a gas-tight interior housing. The piston arrangement includes at least four individual rotary pistons which are constructed essentially equally and have end faces which are arranged so as to be in alignment with each other. Each rotary piston is connected to a shaft, wherein the shafts are mounted in the housing so as to be rotatable, wherein the shafts extend through the geometric center axes of the rotary pistons and wherein the shafts are synchronized so as to rotate with each other by means of a gear system. The shafts serve to rotate the rotary pistons in the same direction of rotation about their geometric center axes which extend perpendicularly to the end faces and/or cross-sections of the rotary pistons. The rotary pistons are constructed as straight cylinders whose cross-sections extending parallel to the end faces of the rotary pistons are each defined by four circular arcs with two different radii, wherein the circular arc portions having the same radius also have the same arc lengths, and wherein the circular arc portions are joined alternatingly in connection points where the circular arc portions are connected to each tangentially. The rotary pistons define with their curved circumferential surfaces an inner work chamber, wherein a gap with a periodically changing width is present in each position between adjacent rotary pistons. The rotary piston machine further includes sealing assemblies composed of positioning members and sealing rods, wherein a sealing assembly is provided for each gap between adjacent rotary pistons and wherein each sealing assembly includes at least one sealing rod. The sealing rod has a cross-sectional width which is greater than the width of the gap. The sealing rod is held in its position relative to the gap by means of at least one positioning member which extends between two adjacent rotary pistons. The sealing rod has a length which corresponds at most to the length of the rotary piston.

2. Description of the Related Art

In a known rotary piston machine with sealing assemblies disclosed in U.S. Pat. No. 3,809,026, the rotors have an elliptical cross-section and the sealing assemblies are composed of sealing rods which partially have round cross-sections and which are rigidly connected to each other through a connecting member. As a result of this configuration, generally only one of the two sealing rods of each sealing assembly rests against the outer surfaces of the rotors, while the other sealing rod projects freely and without contact, as shown in FIG. 8 of U.S. Pat. No. 3,809,026. Consequently, the sealing rods are not guided, they move back and forth during operation and must be moved into the sealing position with additional aids, for example, the interior pressure. Another disadvantage is the extraordinary high friction between the rigid sealing rods and the circumferential surfaces of the rotary pistons, wherein each rotary piston is contacted at least twice by the sealing rods.

French Patent 657 191 and EP 0 339 034 B1 disclose rotary piston machines which have similar disadvantages with respect to sealing friction. In the embodiment of French Patent 657 191, increased friction results from internal pressure, centrifugal force and rigid sealing rods in frictional direction. In the embodiment of EP 0 399 034 B1, the increased friction results from the wedge-shaped profile of the rigid sealing rods in connection with the internal pressure.

SUMMARY OF THE INVENTION

Therefore, it is the primary object of the present invention to improve the sealing system of a specific rotary piston machine which has an inner work space defined radially only by at least four rotary pistons.

In accordance with the present invention, the center points of the circular arcs with the two different radii defining the cross-section of each rotary piston are located on the corner points of a rhombus and the center points of the larger circular arcs are located in the corner points with the larger rhombus angles, wherein the larger rhombus angle is greater by 5° to 50° than the smaller rhombus angle, and wherein the sealing rods have cross-sectional areas in a direction perpendicularly to the longitudinal axes of the sealing rods which are defined outwardly by a circle, and wherein the sealing rods are freely rotatable about their longitudinal axes.

The sealing rods in accordance with the present invention are of simple construction and can be easily manufactured. The sealing rods can be pushed axially into the gap area between two adjacent rotary pistons and, thus, the sealing rods can be easily mounted. Consequently, they can also be replaced easily by removing an end wall of the housing. The sealing rods are not rigidly connected to the rotary pistons which they serve to seal relative to each other. Rather, the sealing rods are held in their place by the positioning members pushed into the gaps between adjacent rotary pistons, wherein the positioning members, in turn, are supported with their cylindrical guide members on the circumferential surfaces of the rotary pistons. In this configuration, one of the two cylindrical guide members of a positioning member is located on one side of the gap and the other cylindrical guide member is located on the other side of the same gap. Both cylindrical guide members have cross-sectional dimensions which are so large that they cannot be moved through the gap and they are connected to each other through at least one connecting member. Because of the connecting member extending through the gap and connecting the cylindrical guide members, the two cylindrical guide members of one positioning member cannot move apart from each other. Consequently, the cylindrical guide members are generally pushed in axially between two adjacent rotary pistons or are pulled out axially. The cylindrical guide members may include bores or pins or projections for holding the sealing rods in their positions relative to the gap without preventing a rotation of the guide rollers about the longitudinal axes of the sealing rods.

The gap between two adjacent rotary pistons is defined by the circular arcs having two different radii which also define the cross-sections of the rotary pistons. Depending on the relative position between two adjacent rotary pistons, wherein the principal axes of the cross-sections located in a plane are always extending perpendicularly to each other, the gap is defined by a circular arc with a large radius on one side and a circular arc with a small radius on the other side, by a mixture of both circular arcs in the areas of the connecting points, or a circular arc with a small radius on one side and a circular arc with a large radius on the other side. Consequently, during practical operation, the shape of the gap changes continuously. In order to ensure that the spacing between the circumferential surfaces of the rotary pistons is sufficiently narrow in all positions of rotation of the rotary pistons for guiding the guide rollers of each positioning member, the actual gap width of the gap must change periodically because the two guide rollers of a positioning member are always spaced at the same distance from each other because of the connecting member. The actual gap width is the greatest when the principal axis of the rotary piston includes with the connecting line of the axes of two adjacent rotary piston shafts in a cross-sectional plane an angle of 45°, so that the rotary pistons assume a V-position. If this angle is 0°, the actual gap width of the gap is smallest and the rotary pistons assume a T-position. During operation, the acceleration acting on the sealing rods in V-position is the greatest and the acceleration is smallest in T-position with greatest speed. In these two extreme positions of the rotary pistons, i.e., the V-position and the T-position, the cylindrical guide members of a positioning member are supposed to rest as closely as possible to the circumferential surfaces of the rotary pistons, i.e., the smallest possible relative distance between two cylindrical guide members of a positioning should be the same in the T-position of the rotary pistons as in the V-position.

This geometric requirement can only be achieved if the center points of the circular arcs with the smaller radius and the larger radius defining the cross-section of the rotary piston are located on the corner points of a rhombus and the center points of the larger circular arcs are located in the corner points with the greater rhombus angles, wherein the larger rhombus angles are greater by 5° to 50° than the smaller rhombus angles. Only when this geometric requirement is met and the rotary pistons have the smaller and larger radii and the angles described above, the necessary distance between the axes of two adjacent rotary pistons can be determined when the diameter of the sealing rod is selected, wherein the two cylindrical guide members of a positioning member are guided in a gap which is sufficiently narrow in V-position as well as in T-position of the rotary pistons. The necessary distance between the axes can be determined by incrementally increasing or decreasing the distance. If a square were selected instead of a rhombus, the smallest possible distance of the cylindrical guide members in the T-position would always be smaller than in the V-position and a good guidance of the positioning members would not be possible. In the rotary piston cross-sections shown in FIG. 5 and 6 of EP 0 339 034 B1, the center points of the circular arcs defining the rotary piston cross-sections are located on the corner points of squares.

The present invention provides the particular advantage that the changed shape of the conventional rotary piston makes it possible to use sealing rods in the form of round rods which operate well and rest tightly against the circumferential surfaces of the rotary pistons, so that the sealing rods roll on the rotary pistons which rotate in the same direction and the friction at the rotary pistons resulting from rolling friction is reduced.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
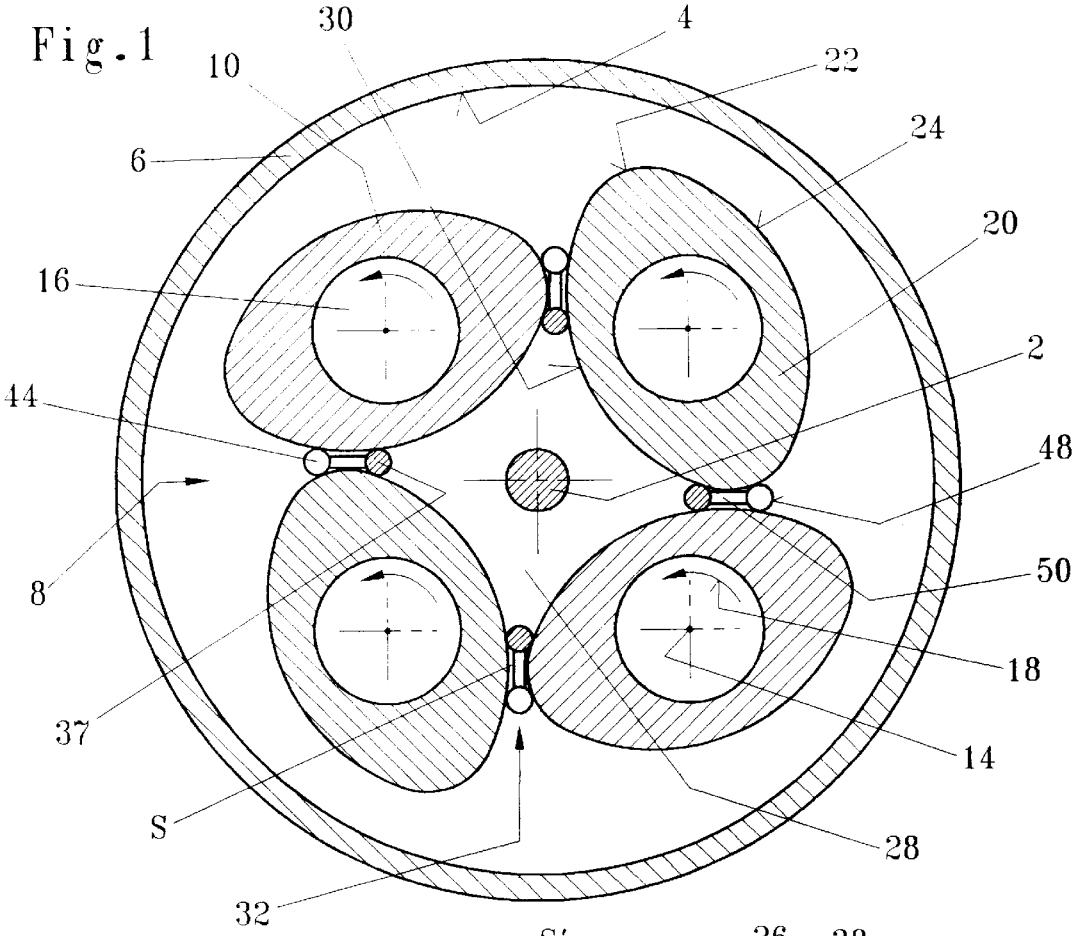
FIG. 1 is sectional view of a rotary piston machine according to the present invention with sealing assemblies inserted between the rotary pistons.

FIG. 1 is a sectional view of a piston arrangement 8 of a rotary piston machine which is mounted in a gas-tight interior 4 of a housing 6. The piston arrangement 8 is composed of four rotary pistons 10 which are constructed identically as straight cylinders. FIG. 1 shows the cross-sections 20, wherein the end faces 12 are identical. The end faces are defined by altogether four circular arc portions 22, 24 which have different radii, namely, a larger radius R and a smaller radius r. The center points of the circular arcs of the portions 22, 24 are located in the corner points 38, 40 of a rhombus and the center points of the larger circular points 24 are located in the corner points 40 at the larger rhombus angles, wherein the larger rhombus angle $\alpha$ is 5° to 50° greater than the smaller rhombus angle $\beta$. The circular arc portions 22, 24 are alternatingly joined together at connecting points 26, wherein the circular arc portions 22, 24 are tangentially connected to each other.

Each rotary piston 10 is connected to a shaft 16 which is mounted in the housing 6 so as to be rotatable. The shaft 16 extends through the geometric center axis 14. The individual shafts are synchronized to rotate with each other by means of a gear system, so that the relative angular positions of the individual rotary pistons 10 to each other are maintained. The rotary pistons 10 are rotatable in the same direction of rotation in the direction of arrow 18. The end faces of the rotary pistons 10 are arranged so as to be in alignment with each other, i.e., they are located in the same planes. The four rotary pistons 10 define laterally with their curved circumferential surfaces 30 an inner work chamber 28 which is defined at its end areas by surfaces of the housing 6, wherein the surfaces defining the chamber are kept at a distance from each other by a spacer rod 2. A gap S exists between adjacent rotary pistons 10, wherein the actual gap width S' changes periodically with the rotation of the rotary pistons 10. The gap width S' is the greatest when the principal axis 84 of the rotary piston forms with the line 86 connecting the axes an angle $\phi$ of 45° and it is the smallest when the angle $\phi$ is 0°.

Sealing assemblies 32 are provided for effecting a sealing action between adjacent rotary pistons 10. A sealing assembly 32 is provided for each gap S. The sealing assemblies 32 are composed of positioning members 34 and sealing rods 36, wherein each positioning member 34 has two cylindrical guide members 44 resting in the gap area between the rotary pistons 10 against the circumferential surfaces 30 of the adjacent rotary pistons and, thus, the sealing assembly is centered in the gap area. In addition, the two guide cylindrical guide members 44 of a positioning member 34 are connected to each other by means of at least one connecting member 50 which extends between two adjacent rotary pistons 10, so that the two cylindrical guide members 34 cannot move apart from each other. Also, the two cylindrical guide members 44 of a positioning member 34 have cross-sectional dimensions which are so large that they cannot be moved through the gap. The actual sealing action in the gap between two adjacent rotary pistons 10 is achieved by means of a round sealing rod 36 whose cross-section 37 is outwardly defined by a circle and which is held in its position relative to the gap by projections 52 or bores 54 and/or pins 56 of the cylindrical guide members 44.

The distance A between the axes of two adjacent rotary pistons 10 in FIG. 1 results from the selected dimensions R and r of the rotary pistons and the rhombus angle a and the selected diameter d of the sealing rod, wherein the distance A must be so large that the smallest possible relative distance E between two cylindrical guide members 44 of a positioning member 34 in the rotary piston position with V =45° or the greatest gap width S' is the same as the smallest possible relative distance between these cylindrical guide members 44 in the rotary piston position with $\phi$=0° or the smallest gap width S'.

The determination of the corresponding distance A between the axes can be carried out by graphical or computational iteration. In a practical example, the large radius R is 60 mm, the small radius r is 20 mm, the large rhombus angle $\alpha$ is 100° and the sealing rod diameter d is 7.5 mm. The determined distance A between the axes is 89.2 mm. A side of the rhombus is always equal to the difference R−r −40 mm in the illustrated embodiment—which also results from the geometric requirement for tangential transitions at the connecting points 26 of the circular arc portions 22, 24.

In the illustrated embodiment, particularly also in FIG. 1, the cross-sections 46 of the cylindrical guide members 44 are defined by circle circumferences 48 which have the same radius as the sealing rods 36. In the rotary piston position in which $\phi$=45° and in the rotary piston position in $\phi$=0°, the center points of the circles whose circumferences 48 define the cross-sections 46 of the cylindrical guide members 44 in the contact areas with the rotary pistons 10 are located on the center axes 42 of the corresponding sealing rods 36 resting against the circumferential surfaces 38 of the rotary pistons. This geometric relationship is also true if the radii of the circle circumferences 48 of the cylindrical guide member cross-sections 46 are greater than the radii of the sealing rod cross-sections 37. Accordingly, in the illustrated embodiment in which R=60 mm and r=20 mm, if the rotary piston 10 has a groove 64 having a depth of 4 mm for guiding larger cylindrical guide members 44 with wider connecting members 50, the radius of the circle circumference 48 defining the guide roller cross-section 46 must at least in the contact area with the rotary pistons 10 be greater by 4 mm than the radius of curvature of the sealing rod surfaces 34 resting against the circumferential surfaces 30 of the rotary pistons. The radius of the circle circumference 48 defining the cylindrical guide member cross-section 46 would then assume the value 7,75 mm at least in the contact area with the rotary pistons 10. For manufacturing reasons, it is usually useful to define the cylindrical guide member cross-section over its entire area by the circle circumference 48.

A very practical method of determining the optimum distance between the axes of two adjacent rotary pistons is as follows.

After previously selecting values for the radii R and r and the rhombus angle $\alpha$, so that a well defined rotary piston contour is obtained, a sealing rod diameter having a corresponding relative size is selected.

Subsequently, a pair of rotary pistons is drawn in the T-position ($\phi$=0°), wherein the gap width S' is initially zero. Then a circumferential line is drawn around the end faces of the rotary pistons at a distance which corresponds to the sealing rod radius, as the geometric location for the center points of the sealing rod cross-sections. Subsequently, a V-position ($\phi$=45°) is drawn over the T-position drawn as described above. In the T-position as well as in the V-position, the surrounding lines at the distance of the sealing rod radius intersect in two points each, wherein the distance between the points in the V-position is initially greater than in the T-position. One of the rotary pistons is then pulled with its view drawn over the rotary piston in a stepwise manner from the opposite rotary piston in the direction of the connecting line 86 (increase of the distance between the axes) until the distance between the points is the same in the T-position and the V-position. The distance between the axes which has now been reached is the optimum distance A. The method described above is particularly suitable when using computer-assisted drawing devices (CAD-devices).

Figure 2:
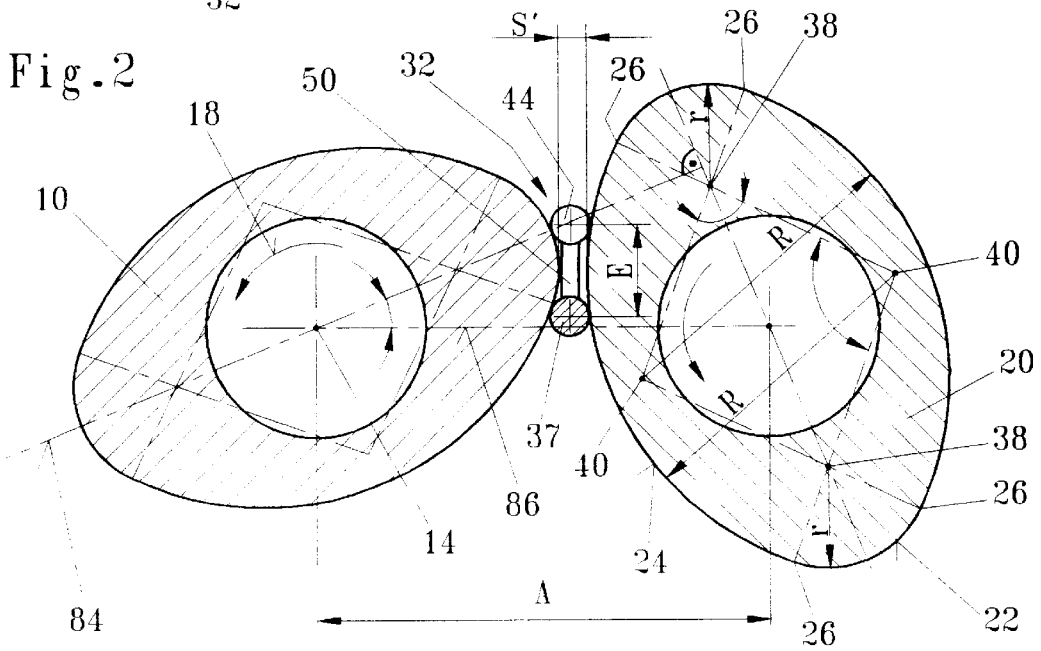
FIG. 2 is a sectional view, on a larger scale, of a pair of rotary pistons with the sealing assembly of FIG. 1.
Figure 3A:
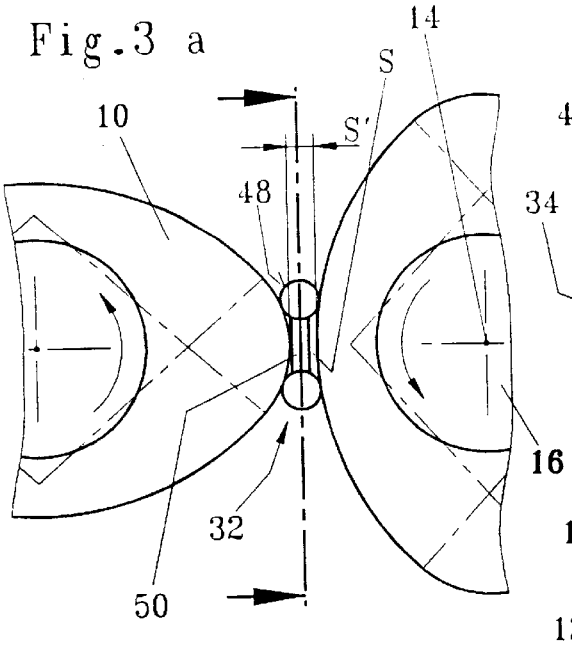
FIGS. 3*a* and 3*b* show a pair of rotary pistons with a sectional view of a sealing assembly according to FIGS. 1 and 2 with pins.
Figure 3B:
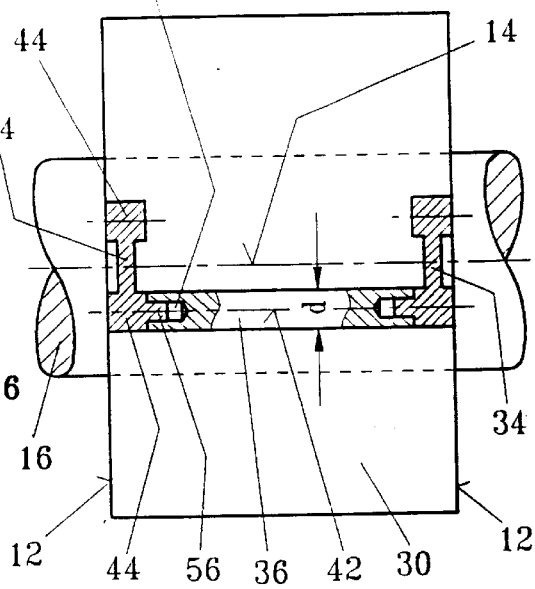

In the embodiment according to FIGS. 1–3*b*, each sealing assembly 32 is composed of two positioning members 34 and a sealing rod 36. The sealing rod 36 is held by pins 56 which are provided at each of the two cylindrical guide members 44 of a positioning member 34 and which engage in bores 60 of the sealing rod 36. The circle circumferences 48 of the cylindrical guide member cross-sections 46 have the same outer diameter as the sealing rods 36. In FIG. 2, the angle of rotation $\phi$=22.5°, and in FIGS. 3*a* and 3*b*, the angle of rotation $\phi$=0°.

Figure 4A:
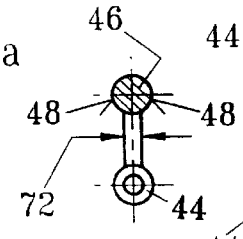
FIGS. 4*a* and 4*b* are a front view and a side view, respectively, of a positioning member of the sealing assembly according to FIG. 1 to 3*b;*
Figure 4B:
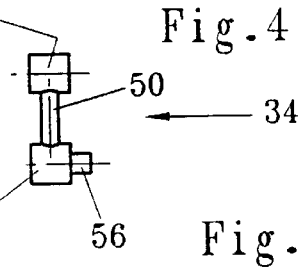

In the embodiment according to FIGS. 4 and 4b, a positioning member 34 with cylindrical guide members 44, pins 56 and connecting member 50 is shown as it is used in FIGS. 1–3*b*.

Figure 5A:
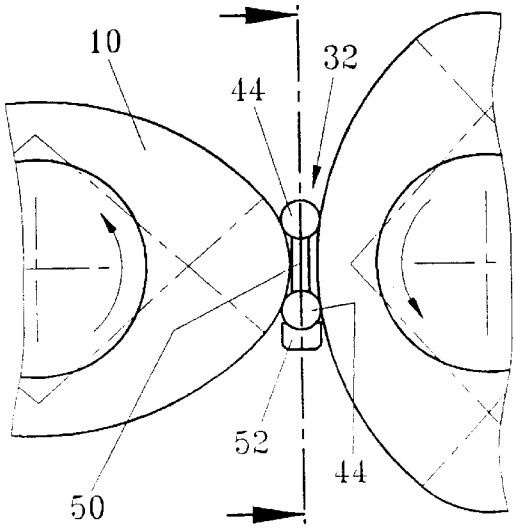
FIGS. 5*a* to 5*b* show a pair of rotary pistons with a sectional view of a sealing assembly with projections.
Figure 5B:
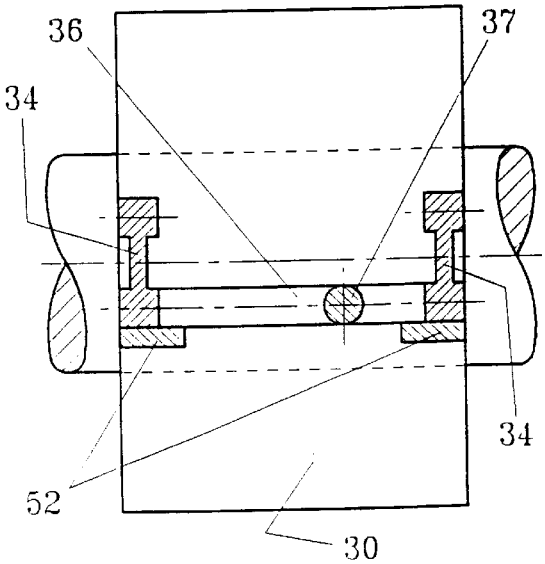

In the embodiment according to FIGS. 5*a* and 5*b*, a sealing assembly 32 is shown in longitudinal section in which projections 52 are provided in the positioning member 34 for holding the sealing rod 36.

Figure 6A:
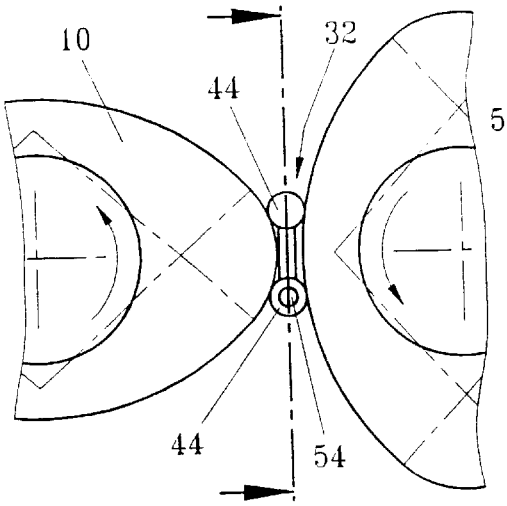
FIGS. 6*a* and 6*b* show a pair of rotary pistons with a sectional view of a sealing assembly with guide shaft and a sealing rods.
Figure 6B:
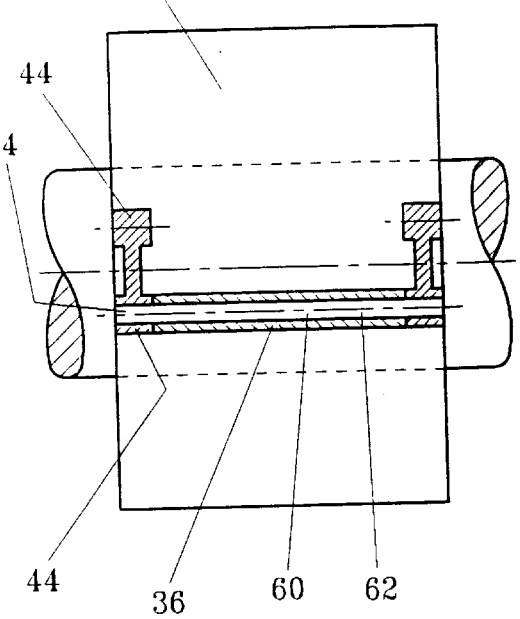

In the embodiment according to FIGS. 6*a* and 6*b*, a sealing rod 36 with longitudinal bore 60 is shown which is rotatably mounted on a guide shaft 62. The lateral ends of the guide shaft 62 are held in bores 54 of the cylindrical guide members 44.

Figure 7A:
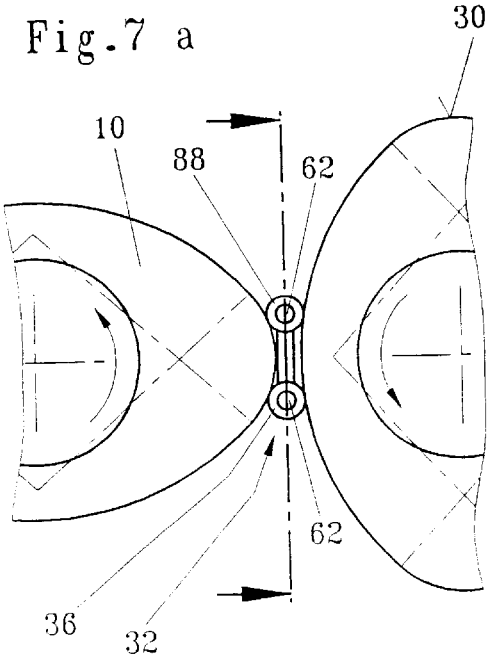
FIGS. 7*a* and 7*b* show a pair of rotary pistons with a sectional view of a sealing assembly with only one positioning member, one guide shaft, balancing rollers and two sealing rods.
Figure 7B:
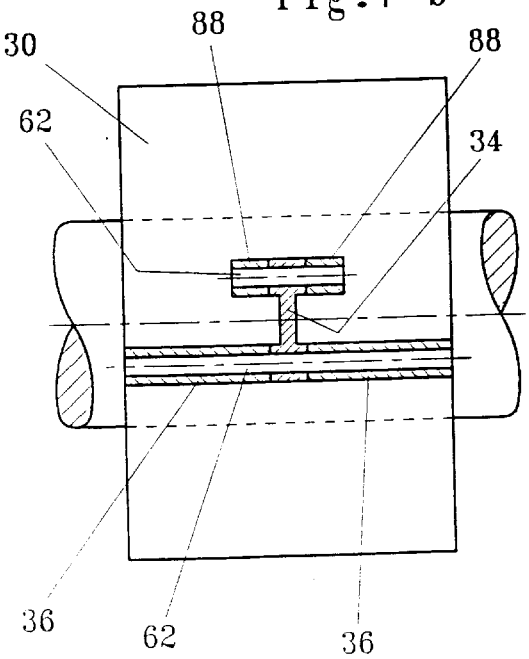

In the embodiment according to FIGS. 7*a* and 7*b*, a sealing assembly 32 is shown which is composed of a positioning member 34, two guide shafts 62, two sealing rods 36 and two rotatably mounted balancing rollers 88. The positioning member 34 is additionally supported through the balancing rollers 88 against the circumferential surfaces 30 of the rotary pistons and reduces the friction as a result.

Figure 8A:
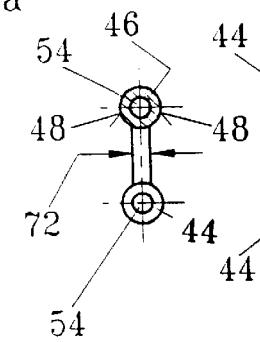
FIGS. 8*a* and 8*b* are a front view and side view, respectively, of the positioning member according to FIGS. 7*a* and 7b.
Figure 8B:
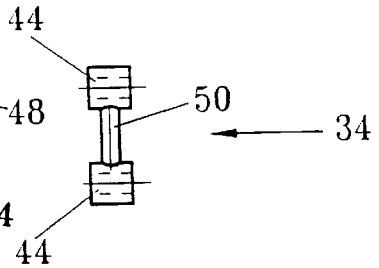
Figure 9A:
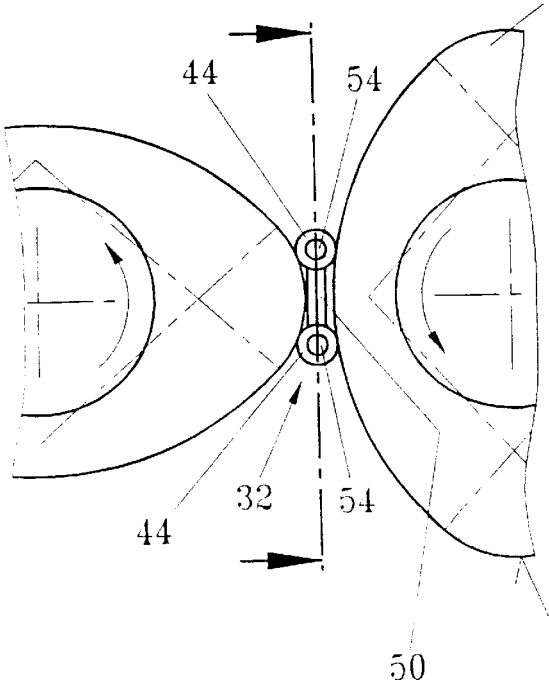
FIGS. 9*a* and 9*b* show a pair of rotary pistons with a sectional view of a sealing assembly with positioning members according to FIGS. 8*a* and 8*b* and two sealing rods.
Figure 9B:
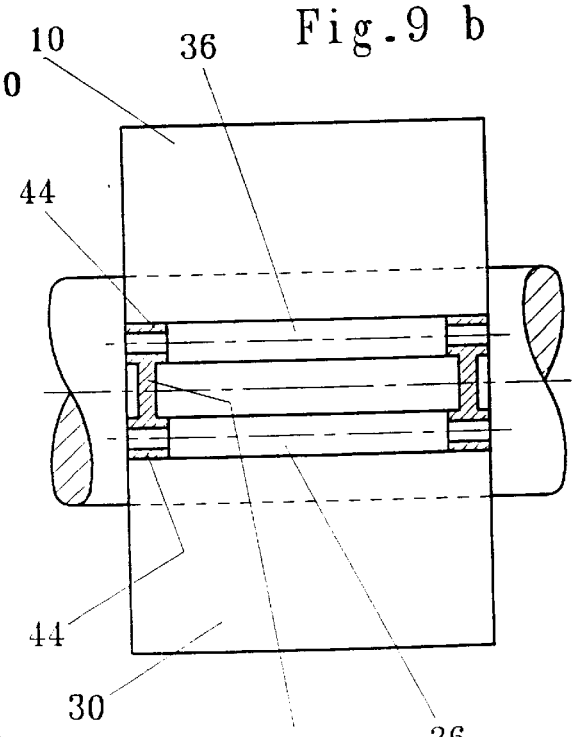

In the embodiment according to FIGS. 8*a* and 8*b*, a positioning member 34 is shown as it is used in the embodiment of FIGS. 7*a* and 7*b* and the embodiment of FIGS. 9*a* and 9*b*. The cylindrical guide members 44 connected to each other through a connecting member 50 have bores 54 for receiving guide shafts 62 or pins.

In the embodiment according to FIGS. 9*a* and 9*b*, a sealing assembly 32 is shown with two oppositely located parallel sealing rods 36, wherein the sealing rods 36 are rotatably supported through integrally connected pins in the bores 54 of the cylindrical guide members 44.

Figures 10A, 10B:
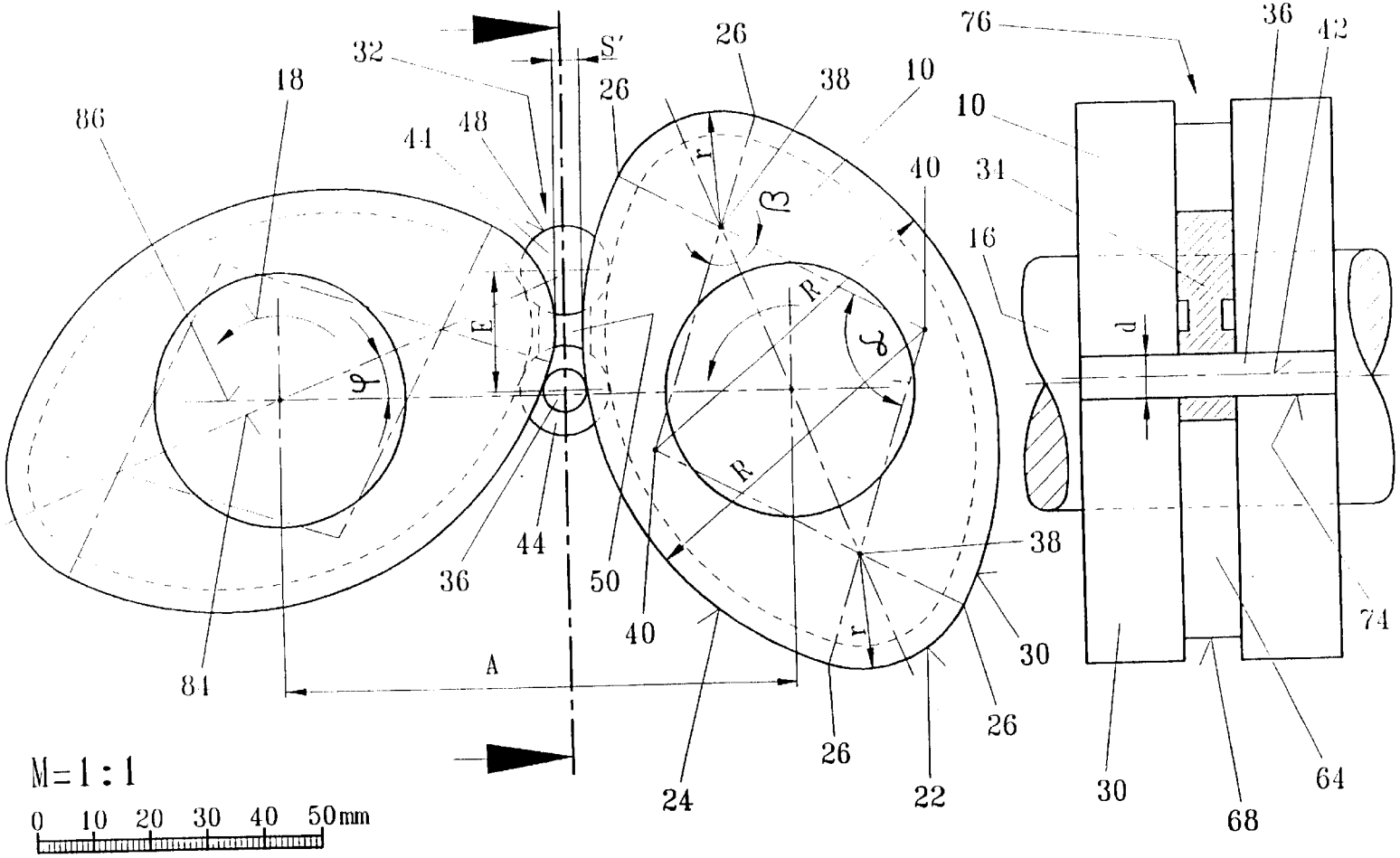
FIGS. 10*a* and 10*b* show a pair of rotary pistons with a circumferential groove each having a rectangular profile and a sectional view of a positioning member with a sealing rod.

In the embodiment according to FIGS. 10*a* and 10*b*, a sealing assembly 32 is shown with a rotatably supported sealing rod 36 and a positioning member 34 whose cylindrical guide members 44 are guided in grooves 64 which are formed in the circumferential surfaces 30 of the rotary pistons and have the same depth over their entire lengths. FIGS. 10*a* and 10*b* show the practical embodiment on a scale of 1:1.

Figure 11A:
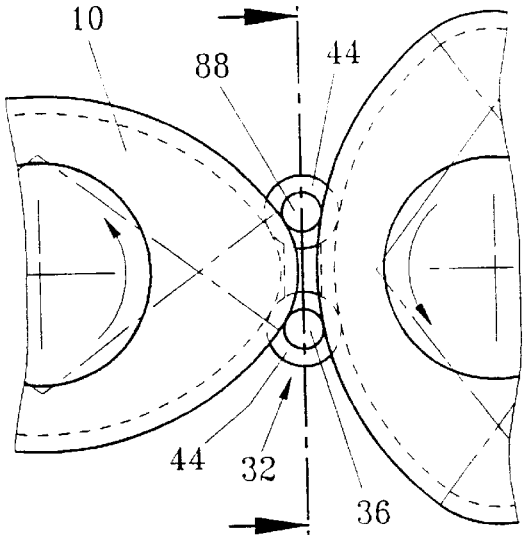
FIGS. 11*a* and 11*b* are identical to FIGS. 10*a* and 10*b*, except for showing additional balancing rollers.
Figure 11B:
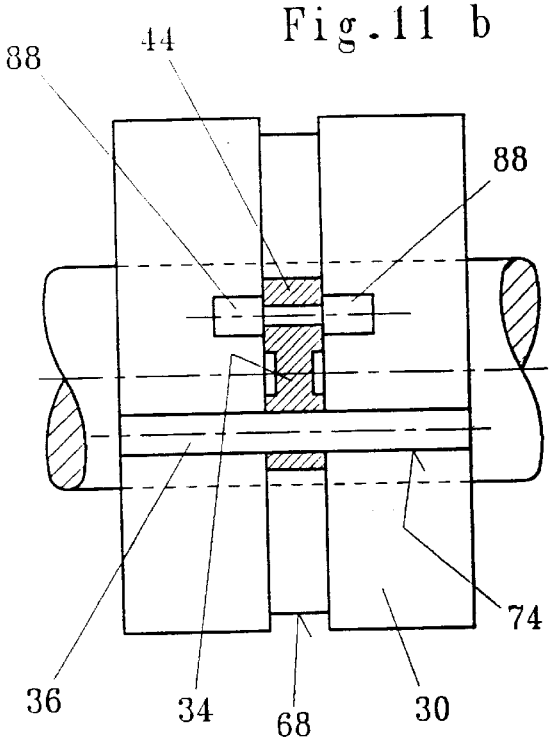

In the embodiment according to FIGS. 11*a* and 11*b*, which is identical to the embodiment of FIGS. 10*a* and 10*b* except for the rotatably supported balancing rollers 88, the advantage of reduced friction is provided as in the embodiment according to FIGS. 7*a* and 7*b*.

Figure 12A:
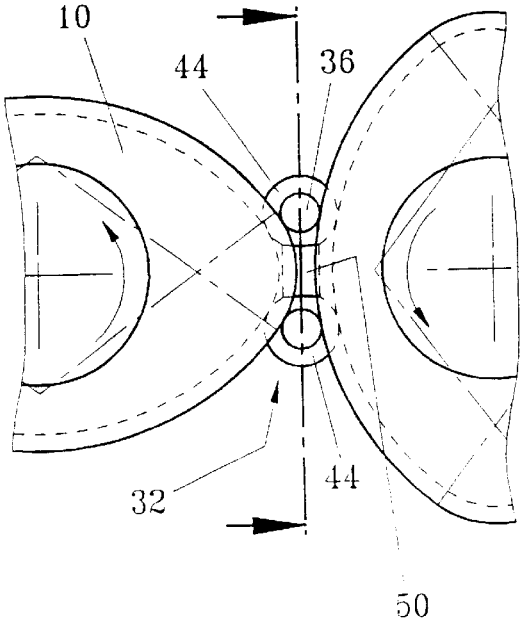
FIGS. 12*a* and 12*b* are identical to FIGS. 10*a* and 10*b*, except with a rounded groove bottom and two sealing rods.
Figure 12B:
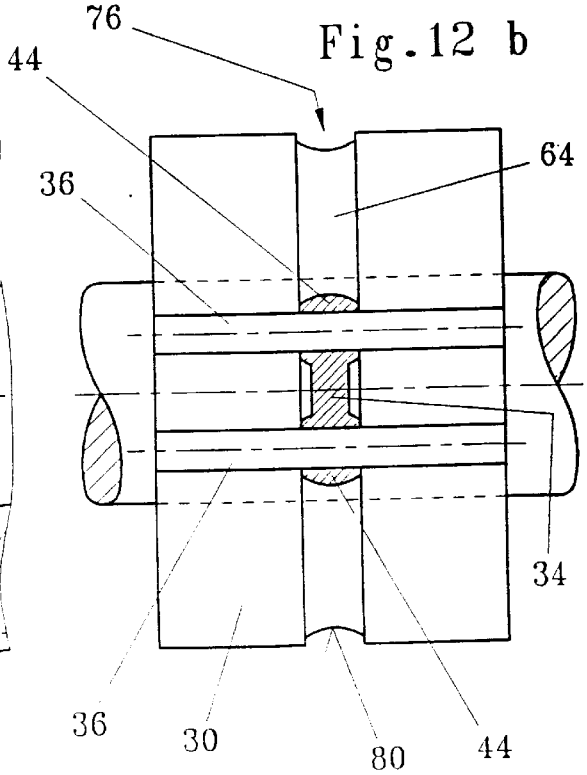

In the embodiment according to FIGS. 12*a* and 12*b*, a sealing assembly 32 is shown which is constructed similarly to that of FIGS. 10*a* and 10*b*, but with two sealing rods 36 and rounded portions 80 in the groove bottom 68. The cylindrical guide members 44 are rounded correspondingly.

In FIGS. 10*a*–12*b*, the respective grooves 64 have the same cross-sectional profile 76 over their entire lengths.

Figure 13A:
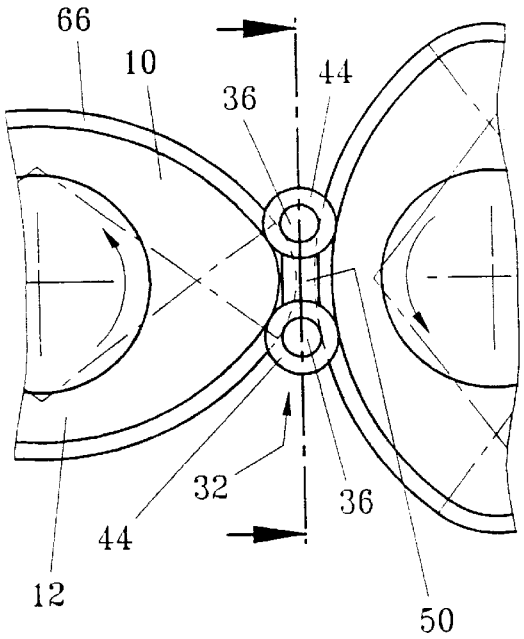
FIGS. 13*a* and 13*b* show a pair of rotary pistons with two rounded steps each, two positioning members and two sealing rods.
Figure 13B:
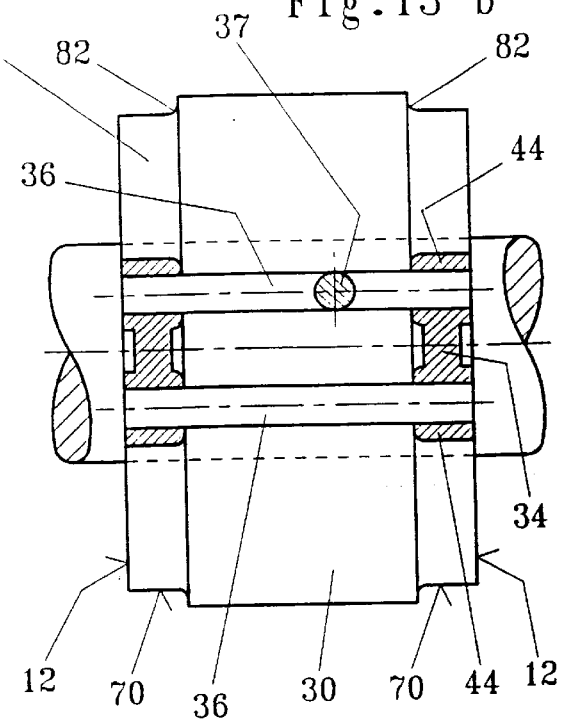

In the embodiment according to FIGS. 13*a* and 13*b*, a sealing assembly 32 is shown with two rotatably supported sealing rods 36 and two positioning members 34 whose cylindrical guide members 44 are guided in steps 66 which are provided on the end faces 12 of the rotary pistons. The steps 66 each have a rounded portion 82 in the step bottom 80, so that the manufacturing process is facilitated. The cylindrical guide members 44 are rounded correspondingly.

Figure 14A:
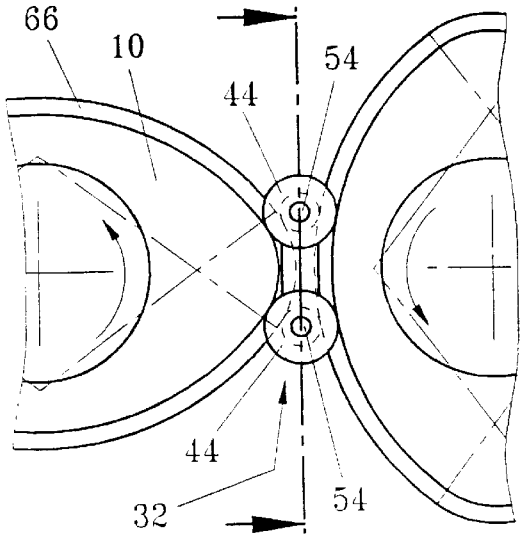
FIGS. 14*a* and 14*b* are identical to FIG. 13*a* and 13*b*, except for showing two guide shafts and two sealing rods with longitudinal bores.
Figure 14B:
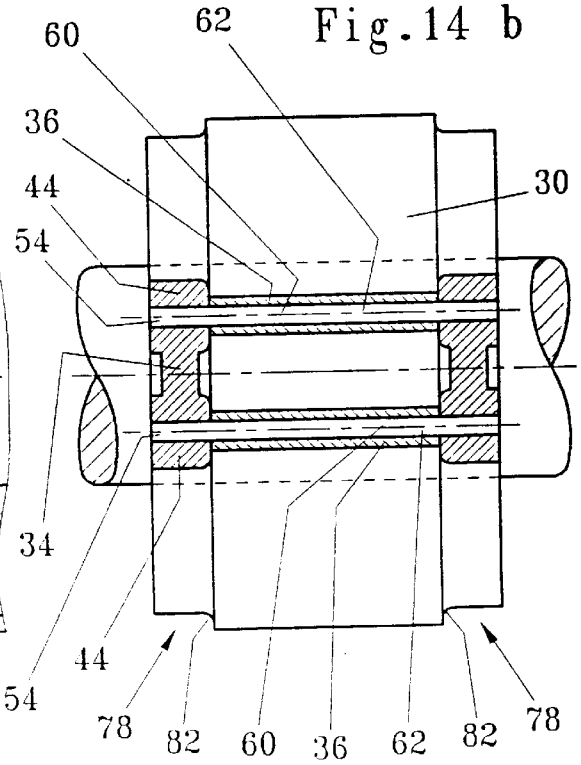

In the embodiment according to FIGS. 14*a* and 14*b*, a sealing assembly 32 is shown which is constructed similarly to that of FIGS. 13*a* and 13*b*, but which has rotatable sealing rods 36 with longitudinal bores 60, wherein guide shafts 62 whose ends are held in bores 54 of the cylindrical guide members 44 are supported in the longitudinal bores 60.

Figure 15A:
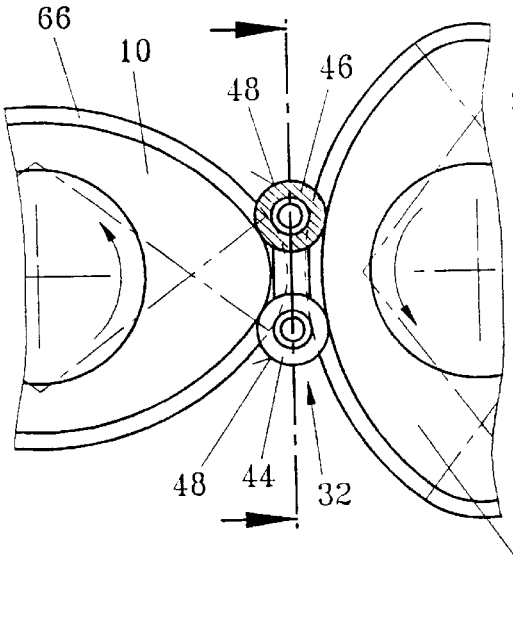
FIGS. 15*a* and 15*b* show a pair of rotary pistons with two rectangular steps each, two positioning members and two sealing rods with sealing disks supported on rollers.
Figure 15B:
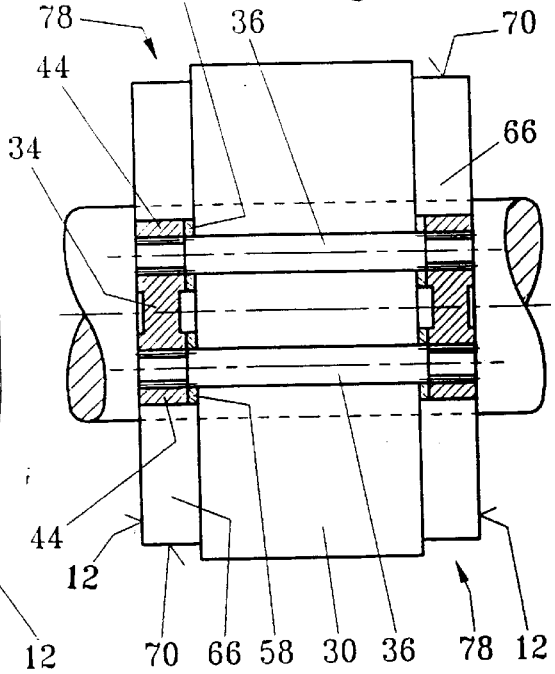

In the embodiment according to FIGS. 15*a* and 15*b*, a sealing assembly 32 is shown which is constructed similarly to that of FIGS. 13*a* and 13*b*, but whose sealing rods 36 are mounted so as to roll on the cylindrical guide members 44, wherein the roller bearing is sealed off by means of sealing disks 58 and the steps 66 do not have rounded portions 82.

In FIGS. 13*a*–15*b*, the respective steps 66 have the same cross-sectional profile 78 over their entire lengths.

Figure 16A:
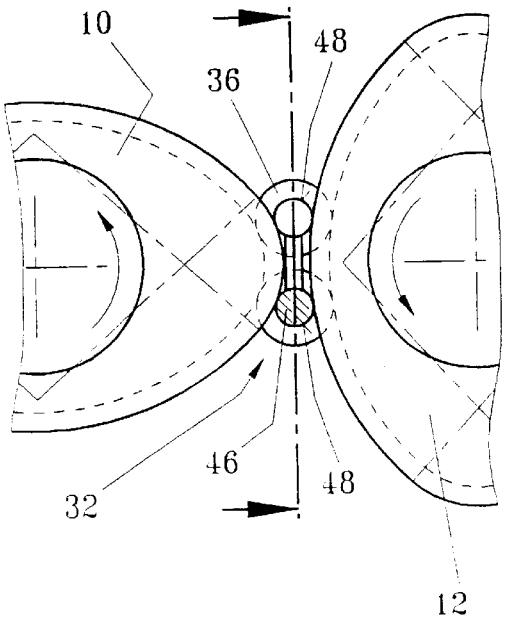
FIGS. 16*a* and 16*b* show a pair of rotary pistons with a sealing assembly, wherein the outer diameter of the sealing rod is greater than the diameter of the circumference of the circle which defines the cross-section of the profile of a guide shaft.
Figure 16B:
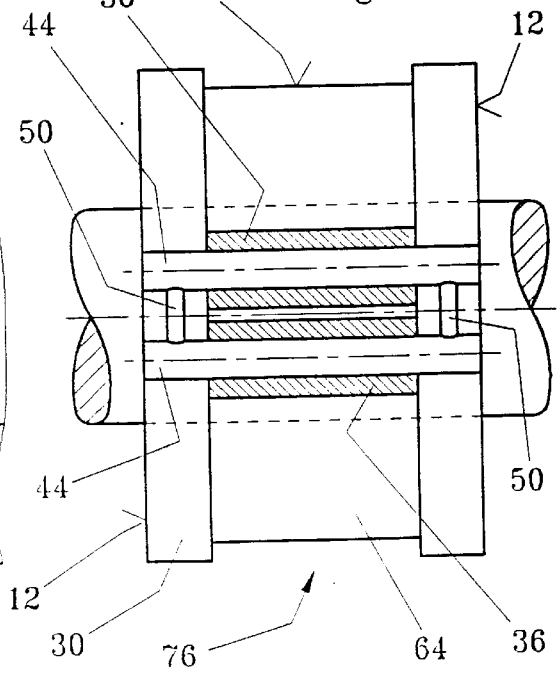

In the embodiment according to FIGS. 16*a* and 16b, a sealing assembly 32 is shown whose sealing rods 36 are rotatably mounted on the cylindrical guide members 34. Consequently, the sealing rods 36 have a greater outer diameter d than the circle circumferences 48 which define the profile cross-sections 46 of the guide rollers 44. During operation, the sealing rods 36 roll on the groove bottom 68 of the groove 64 formed in the rotary piston 10. The increased outer diameter d of the sealing rods advantageously reduces the operational rate of rotation of the sealing rods 36 and increases the wear surface.

Figure 17A:
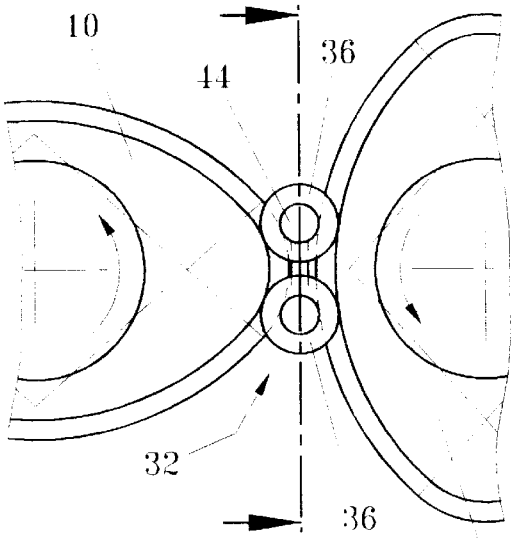
FIGS. 17*a* and 17*b* show a pair of rotary pistons with a sealing assembly in which the axial length of the sealing rods is smaller than their outer diameter.
Figure 17B:
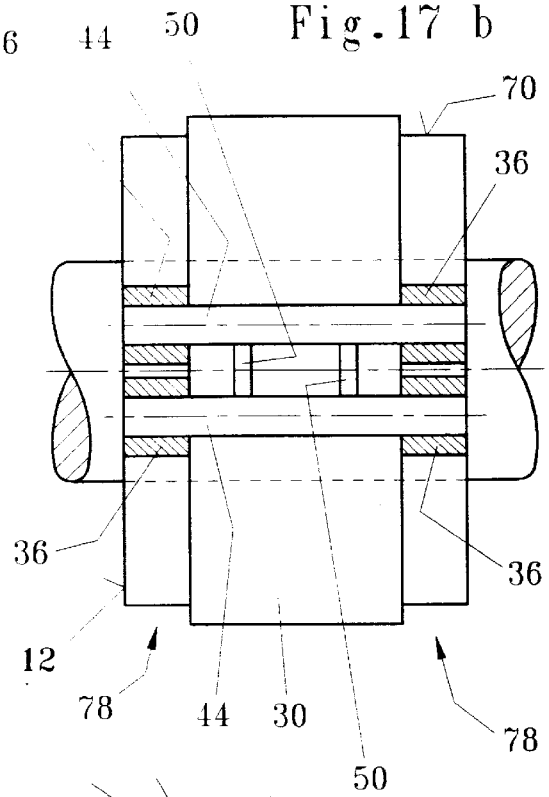

In the embodiment according to FIGS. 17*a* and 17*b*, again a sealing assembly 32 is shown whose sealing rods rotatably mounted on the cylindrical guide members 44 have a greater outer diameter d than the circle circumferences 48 of the profile cross-sections 46 of the guide rollers, wherein the respective axial length of the sealing rods 36 is smaller than the outer diameter d. As compared to FIGS. 16*a* and 16*b*, this produces an advantageous reduction of the movable masses.

Figure 18:
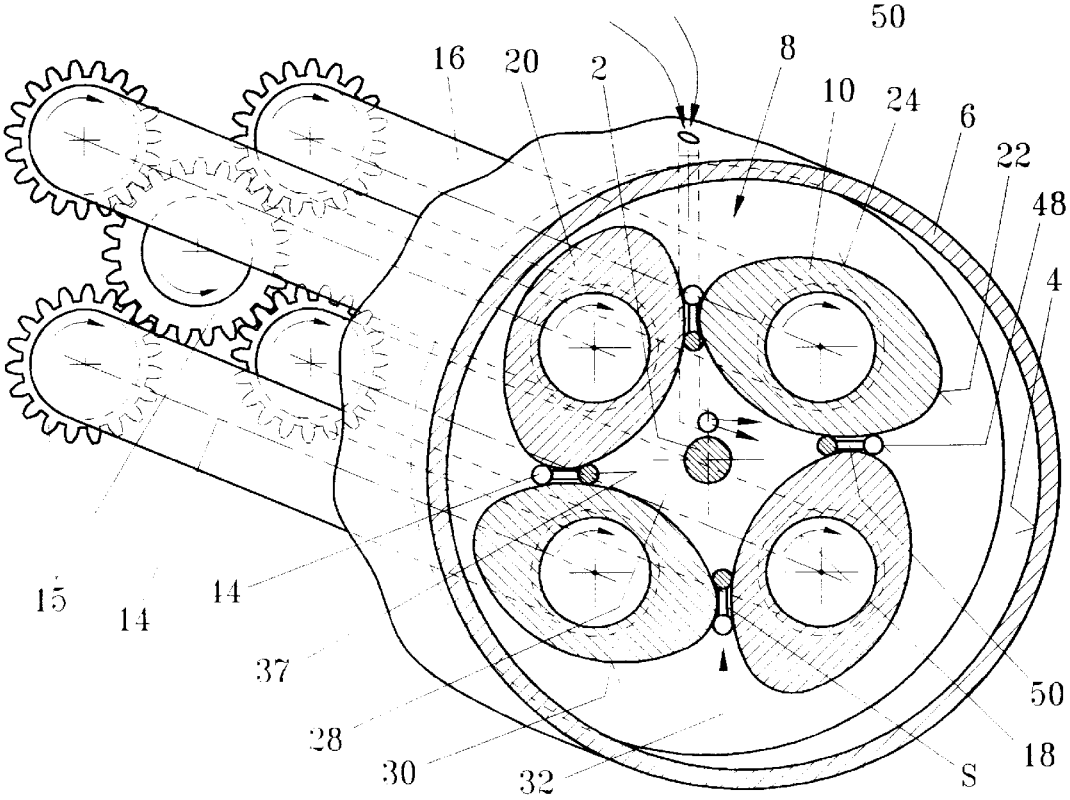
FIG. 18 is a perspective view showing a gear system of the rotary piston machine.

FIG. 18 shows a gear system with gears 15 for rotating the shafts 16.

While specific embodiments of the invention have been shown and described in detail to illustrate the inventive principles, it will be understood that the invention may be embodied otherwise without departing from such principles.

I claim:

1. In a rotary piston machine with a piston arrangement mounted in a gas-tight interior of a housing, the piston arrangement including at least four individual rotary pistons constructed essentially equally and having end faces which are arranged so as to be in alignment with each other, a shaft being connected to each of the rotary pistons, wherein the shafts are mounted in the housing so as to be rotatable, the shafts extending coaxially with geometric center axes of the rotary pistons, a gear system for rotating the shafts in a synchronized manner in the same direction of rotation about geometric center axes extending perpendicularly to at least one of the end faces and cross-sections of the rotary pistons, the rotary pistons being constructed as straight cylinders whose cross-sections extending parallel to the end faces of the rotary pistons are each defined by four circular arcs having two different radii, wherein the circular arc portions having the same radius also have the same arc lengths and are located opposite each other, wherein the circular arc portions are joined tangentially in connection points, the rotary pistons defining with curved circumferential surfaces thereof a work chamber, wherein a gap having a periodically changing width is present in each position between adjacent rotary pistons, the rotary piston machine further including sealing assemblies composed of positioning members and sealing rods, wherein a sealing assembly is provided for each gap between adjacent rotary pistons and wherein each sealing assembly includes at least one sealing rod, the sealing rod having a cross-sectional width which is greater than the width of the gap, the sealing rod being held in a position relative to the gap by means of at least one of the positioning members which extends between two adjacent rotary pistons, the sealing rod having a length which corresponds at most to a length of the rotary pistons, wherein the improvement comprises that center points of the circular arcs with two different radii are located on corner points of a rhombus having larger and smaller rhombus angles, wherein the center points of the larger circular arcs are located in the corner points with the larger rhombus angles, wherein the larger rhombus angle is greater by 5° to 50° than the smaller rhombus angle, and wherein the sealing rods have cross-sectional areas in a direction perpendicularly to the longitudinal axes of the sealing rods which are defined outwardly by a circle, and wherein the sealing rods are freely rotatable about their longitudinal axes.

2. The rotary piston machine according to claim 1, wherein each positioning member comprises two oppositely located parallel cylindrical guide members, wherein the cylindrical guide members rest against two adjacent rotary pistons, further comprising a connecting member for connecting the cylindrical guide members.

3. The rotary piston machine according to claim 2, wherein a cross-section of each of the cylindrical guide members extends parallel to the cross-sections of the rotary pistons and the sealing rods and is defined at least in a contact area with the rotary pistons by a circumference of a circle, the sealing rod having an outer diameter, wherein the circle has a diameter which is one to four times the outer diameter of the sealing rod.

4. The rotary piston machine according to claim 2, wherein the cylindrical guide members have at least one of projections and bores and pins in engagement with the sealing rods for holding the sealing rods in their position relative to the gap.

5. The rotary piston machine according to claim 1, wherein the sealing assembly has at least two sealing rods which extend parallel to each other and have equal outer diameters.

6. The rotary piston machine according to claim 2, comprising at least one of grooves in the rotary pistons and steps in the end faces of the rotary pistons for guiding the cylindrical guide members, wherein the cylindrical guide members are supported on a bottom of the at least one of groove and step.

7. The rotary piston machine according to claim 6, wherein the at least one of grooves and steps have equal cross-sectional profiles over their entire lengths.

8. The rotary piston machine according to claim 6, wherein the at least one of grooves and steps have rounded portions in the bottoms thereof.

9. The rotary piston machine according to claim 2, wherein the connecting member has a width which is 0.2 to 3 times the outer diameter of the sealing rods.

10. The rotary piston machine according to claim 2, wherein the sealing rods are mounted so as to roll on the cylindrical guide members of the positioning members.

11. The rotary piston machine according to claim 2, wherein the sealing rods have longitudinal bores and the cylindrical guide members comprise additional cylindrical guide members or pins, wherein the additional cylindrical guide members or pins are received in the longitudinal bores.

12. The rotary piston machine according to claim 2, wherein one of two cylindrical guide members of a positioning member comprises balancing rollers which additionally rest on the circumferential surfaces of the rotary pistons, wherein the balancing rollers have outer diameters which are equal to the outer diameters of the sealing rods.

13. The rotary piston machine according to claim 2, wherein the outer diameters of the sealing rods are greater than the outer diameter of the circle circumferences at the cross-section of the guide rollers in an area of contact with the rotary pistons.

14. The rotary pistons machine according to claim 1, wherein each sealing rod has an axial length which is 0.2 to 40 times the outer diameter of the sealing rod.

* * * * *